US005464262A

United States Patent [19]

Madrazo

[11] Patent Number: 5,464,262

[45] Date of Patent: Nov. 7, 1995

[54] BALL COLLECTOR RECEPTACLE AND DISPENSER

[76] Inventor: James Madrazo, 11846 Terracina La., Fontana, Calif. 92335

[21] Appl. No.: 257,282

[22] Filed: Jun. 9, 1994

[51] Int. Cl.[6] ..... A63B 47/02

[52] U.S. Cl. ..... 294/19.2

[58] Field of Search ..... 294/19.2; 56/328.1; 221/64, 185; 248/126, 129, 130; 280/47.17, 47.18, 47.24, 47.315; 414/434, 437, 439, 440

[56] References Cited

U.S. PATENT DOCUMENTS

| | | | |
|---|---|---|---|
| 3,371,950 | 3/1968 | Stap | 294/19.2 X |
| 3,820,836 | 6/1974 | Seewagen et al. | 294/19.2 |
| 3,889,996 | 6/1975 | Campbell | 294/19.2 |
| 4,412,697 | 11/1983 | Verde | 294/19.2 |
| 4,461,504 | 7/1984 | Perez et al. | 294/19.2 |
| 4,811,980 | 3/1989 | Ferrari et al. | 294/19.2 |
| 4,844,527 | 7/1989 | Ray | 294/19.2 |
| 5,301,991 | 4/1994 | Chen et al. | 294/19.2 |

FOREIGN PATENT DOCUMENTS

| | | | |
|---|---|---|---|
| 2410489 | 8/1979 | France | 294/19.2 |
| 3826923 | 2/1990 | Germany | 294/19.2 |
| 4023739 | 1/1992 | Germany | 294/19.2 |

*Primary Examiner*—Johnny D. Cherry
*Attorney, Agent, or Firm*—Beehler & Pavitt

[57] ABSTRACT

A ball retrieving and storage receptacle comprising a rectangular basket formed of a pair of parallel tubular frame members spaced apart from each other and connected together by a plurality of parallel tubular members defining the bottom of the basket and spaced apart from each other by slightly less than the diameter of the ball to be retrieved. Castering rollers are provided along one side of the bottom of the basket and a pair of handle U-shaped supports are secured parallel to the frame members to pivot between a first position above the basket for carrying and picking up balls, and a second position below the basket to enable the basket to be placed and supported on a ground surface to provide access to the basket for ball removal and use.

11 Claims, 3 Drawing Sheets

BALL COLLECTOR RECEPTACLE AND DISPENSER

FIELD OF THE INVENTION

This invention relates to the field of devices for collecting, storing and dispensing compressible balls with particular application to the performing of such functions in relation to tennis balls.

BACKGROUND OF THE INVENTION

Since its origin in the 19th Century, the sport of tennis has become increasingly popular to the point where tennis courts are generally found in public parks, High Schools and Middle Schools, hotels and other resorts, and on the grounds of many residences. In areas where the weather may frequently become inclement, special indoor tennis facilities may be constructed, and arrangements often also made for courts to be set up in gymnasiums. Ordinarily, where players oppose each other on opposite sides of the net, only three to six balls may be used by the players and when balls on the ground are to be retrieved, they may be readily picked up and held by the players.

There are many occasions, however, when a single player may desire to practice his serve or other strokes. Where a serve is being practiced and the player is alone on the court, he may wish to serve a large number of balls from one side of the court, and thereafter proceed to the other side to pick up the balls and serve back to the side from which he originally started serving. On other occasions, where the player is practicing strokes with a ball machine, the player may hit a large number of balls directed at him by the ball machine back to the court on which the ball machine is located. Practice of this nature is quite desirable where a player desires to improve his tennis game.

Where such solitary practice is engaged in, the player is then confronted with having to proceed to the other side of the court to retrieve a very large number of balls which he may have hit to such other side of the court.

The problem of retrieving balls and storing them for further use has been addressed in a number of patents, among which are the earlier U.S. Pat. Nos. 3,889,996 and 3,984,138. These patents basically feature ball pick-up baskets.

After balls are picked up particularly if the basket contains a large number of balls, it has been found desirable to provide some type of wheels or rollers on the underside of the basket to enable it to be rolled from one side of the court to the other or elsewhere. Examples of wheeled baskets are found in U.S. Pat. Nos. 4,461,504 and 4,844,527. The latter patent discloses a collector which includes arms to gather up the balls and also means, after the balls have been collected, to enable the basket to be standingly elevated for easy access to the balls in the basket after they have been collected, This feature of elevated access is also found in U.S. Pat. Nos. 4,412,697 and 3,926,465. The latter patent discloses in one embodiment a rolling receptacle.

Among the problems of these earlier devices, however, are the fact that most are not sturdy. Their mechanical features are not reliable and where constructed of wires or thin rods, they may be easily bent to where they may be rendered unfunctional. Further, when the ball containing baskets are elevated, they are set in a single fixed position and must be lifted if it should be desired to move them. In addition, particularly in clubs, resorts and private tennis courts, prior art baskets tend to detract from the beauty of a well designed and well maintained court. What is desired, therefore, is a collector and retainer which is aesthetic, rugged in construction, effective in picking up and retaining balls, readily rollable in any desired direction, and may easily be shifted from the ball collecting function to the position where the balls which have been collected, may easily be accessed by the user for further practice; and, in this latter disposition, may be rolled to different locations on the court for the convenience of the person practicing his or her serve or other strokes.

Lastly, the device should be able to be fabricated and sold for a price which would not be considered unreasonable.

SUMMARY OF THE INVENTION

The present invention provides for the various features last described for a tennis ball collector, retainer and dispenser by being formed of a plurality of tubular members interconnected by suitable tubes and rods. Thus, two substantially rectangular tubular side frames are held apart in parallel spaced relationship by top and bottom tubular members on each side of each frame, with a series of spaced apart parallel tubular members between the frame bottoms to allow balls to be compressed sufficiently to pass between them to be retained in the rectangular container. Castered wheels are anchored at one end of this container, with the bottoms of the wheels lying in the plane of the underside of the container. The four sides of the container may be closed by a canvas or other material which desirably may be colored to match the decor (usually green) of a quality tennis court.

In order to enable the container to be conveniently rolled over the court, either to pick up the balls or to move the container from one side of the court to the other, a pair of pivotal frames are provided, one on each side of the ends of the container with the pivoting being accomplished at the ends of tubular members disposed outside and secured to parallel internal tubular members holding the frames in spaced relationship. These handle frames normally extend well above the container in its picking up position, with the frames having vertically angled members connected together at their tops by transverse elements which desirably may be loosely covered with rubber or other tubes. The latter serve not only the purpose of providing a comfortable gripping element for the handles, but also as a roller when the handle frame is shifted to a second position below the container. This second position is one which is essentially 180 degrees opposite the handle function position and, when the two handle frames are brought below the basket and releasably held by clip elements provided on the bottoms of the container frames, the container is elevated to a position from which balls may be readily removed manually by a player without having to bend over. Should the player desire to move the ball-filled container closer or farther from where he or she is standing, it is only necessary to push the container on the tubular rolls which, in the opposite disposition of the tubular supports, constitute handle grips.

The sides of the container desirably may be closed by providing a canvas rectangle which extends from the upper to the lower tube spacing apart the container frame members. Similarly, an attractive canvas may be provided to lower the ends of the container by extending it between upper and lower tubular members.

While a colored canvas or other fabric may be used to close the sides of the container, other closure materials could be utilized. It is only necessary that such materials be such as to prevent balls from rolling out of the sides or the ends of the container. Thus, even a string net could be utilized. In addition, it may be found desirable to provide a net to extend over the top of the container after it is filled with balls, particularly where the player has picked up all the balls and is through practicing for the day.

Because of its tubular construction, the device of the present invention will be found to be not only rugged, but quite attractive and it may be fabricated at a reasonable cost through bending of the tubes and securing them by rivets or bolts. The device lends itself to being shipped disassembled in a flat box. The purchaser may then assemble the components into the complete container by following a series of simple instructions.

DESCRIPTION OF THE DRAWINGS

In the accompanying drawings.

DESCRIPTION OF THE PREFERRED EMBODIMENT

Figure 1:
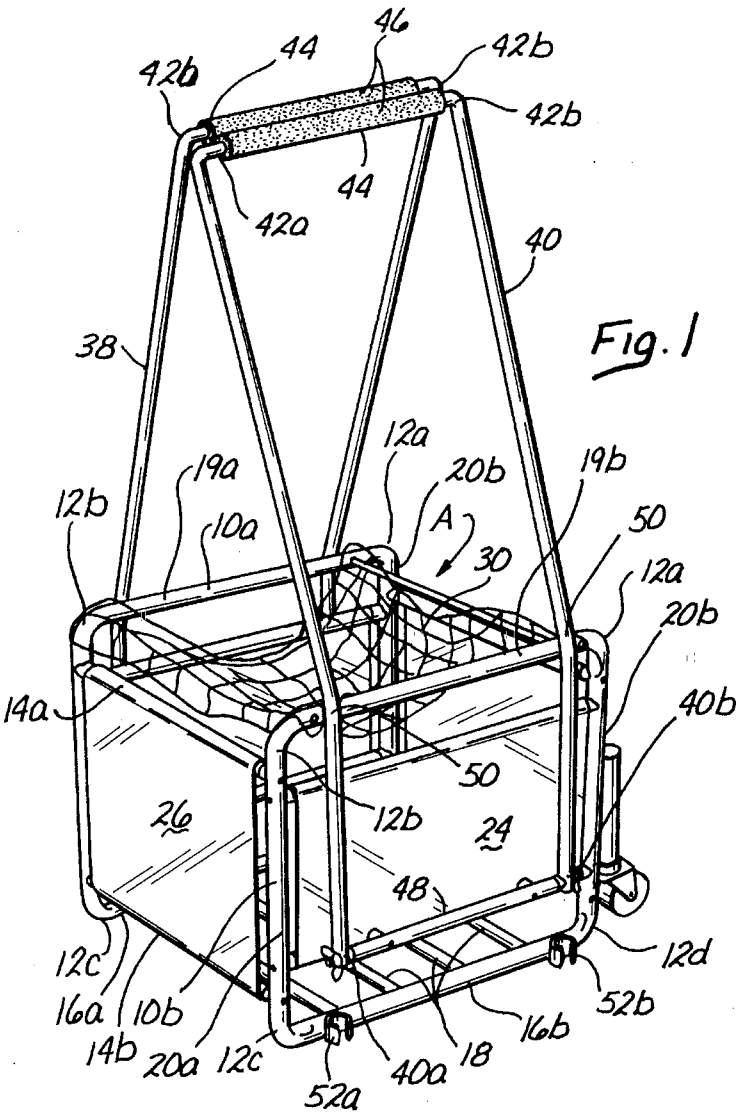
FIG. 1 is a perspective view of a collector/retainer and dispenser of the present invention in its carrying and rolling position.
Figure 3:
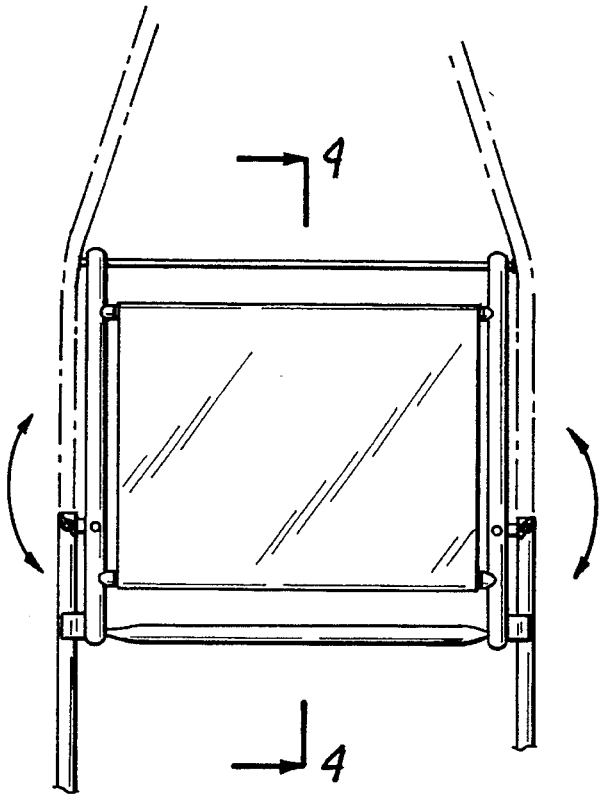
FIG. 3 is a partial end view taken from the left side of FIG. 2, but showing in phantom the carrier members in the FIG. 1 position.

Referring to FIG. 1 of the drawings, the collector/retainer and dispenser (hereinafter "the device") of the present invention comprises a rectangular basket designated generally as A, formed of a pair of spaced-apart rectangular elements 10*a* and 10*b*, preferably of aluminum tubing, bent at right angles to provide corners 12*a*, 12*b*, 12*c* and 12*d*. The elements 10*a* and 10*b* are held apart in parallel correspondence by a pair of tubular members 14*a*, 14*b* spaced apart from each other and extending from adjacent the corners 12*b* and 12*c* at one end, and 12*a* and 12*d* at the opposite end. Also, extending between the bottom 16*a* of the element 10*a* to the bottom 16*b* of the element 10*b* are a plurality of further tubular members 18. These members 18 are secured in parallel spaced from each other by a distance just slightly less than the diameter of the tennis balls to be picked up. Each end tube 18' of the tubes 18 should be similarly spaced from the proximate bottom tubular member 14*b* (see FIG. 4).

Figure 7:
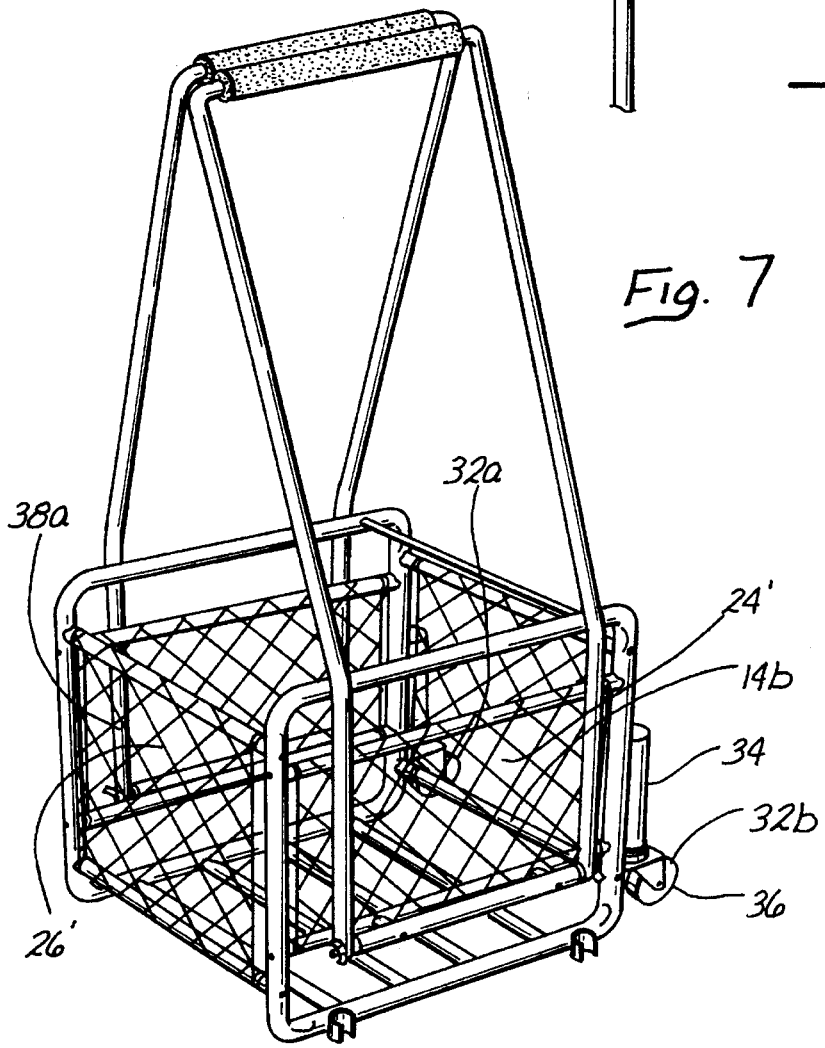
FIG. 7 is a perspective view similar to FIG. 1, but showing melted side walls for the container.
Figure 4:
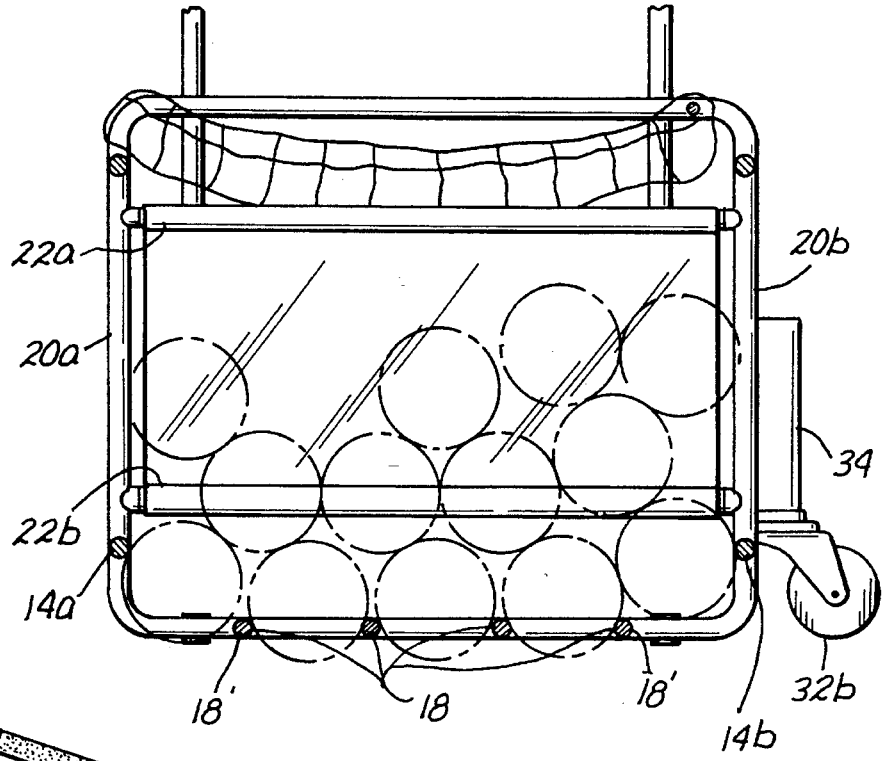
FIG. 4 is a section taken along the line 4—4 of FIG. 3 looking in the direction of the arrows.

Extending between the ends 20*a* and 20*b* of the rectangular elements 10*a* and 10*b*, respectively, are a further pair of tubular members 22*a* and 22*b* as best shown in FIG. 4. The tubular members 22*a* and 22*b* serve to carry some type of side cover webbing 24 or netting 24' (FIG. 7). Similarly, the tubes 14*a* and 14*b* referred to above serve to support a similar webbing or netting 26 (or 26' in FIG. 7). If desired, a netting or other cover 30 may be temporarily provided across the top of the thus formed basket A.

In order to provide rolling type mobility, one of a pair of castered wheels 32*a*, 32*b* is provided on each of the same opposed ends 20*b* of the frame members 10*a*, 10*b*, respectively. These castered wheels 32*a*, 32*b* may be mounted at the lower end of a short tube 34 fixedly attached to the ends 20*b* of the frames 10*a* and 10*b*. Desirably, the disposition of the wheels 32*a*, 32*b* should be such that a tangent to the lowermost portion of each wheel 36 lies in, or slightly above, a plane which would pass under the bottom members 16*a*, 16*b* of the frames 10*a*, 10*b*, respectively.

To provide an effective utilization of the rectangular basket A, the present invention contemplates the use of a pair of carrier elements 38, 40. Each of these carrier elements 38, 40 is formed of aluminum tubing in a U-shape having a pair of open ends 38*a*, 38*b*, respectively, spaced from each other with the opposite ends 42*a*, 42*b* bent at right angles to join each other transversely at 44. A loose rolling rubber or plastic cover 46 is placed over the transverse joint 44.

Each of the open ends 38*a*, 38*b*, and 40*a*, 40*b* is pivotally secured to the end of the short tube 48 which is fixedly attached to the tube 22*b* extending between the ends 20*a* and 20*b* of each frame 10*a*, 10*b*, respectively. Each of the U-shaped carrier elements 38, 40 is bent at 50 which is where the arms 39, 41 of the U-shaped carrier elements 38, 40, respectively, pass the top members 19*a*, 19*b* of the frames 10*a*, 10*b*. The angle of the bends at 50 is such as to bring the transverse members 44 of both closed ends 42*a*, 42*b* together in the manner shown in FIGS. 1 and 7 to constitute the first position for the carrier elements 38 and 40.

Figure 2:
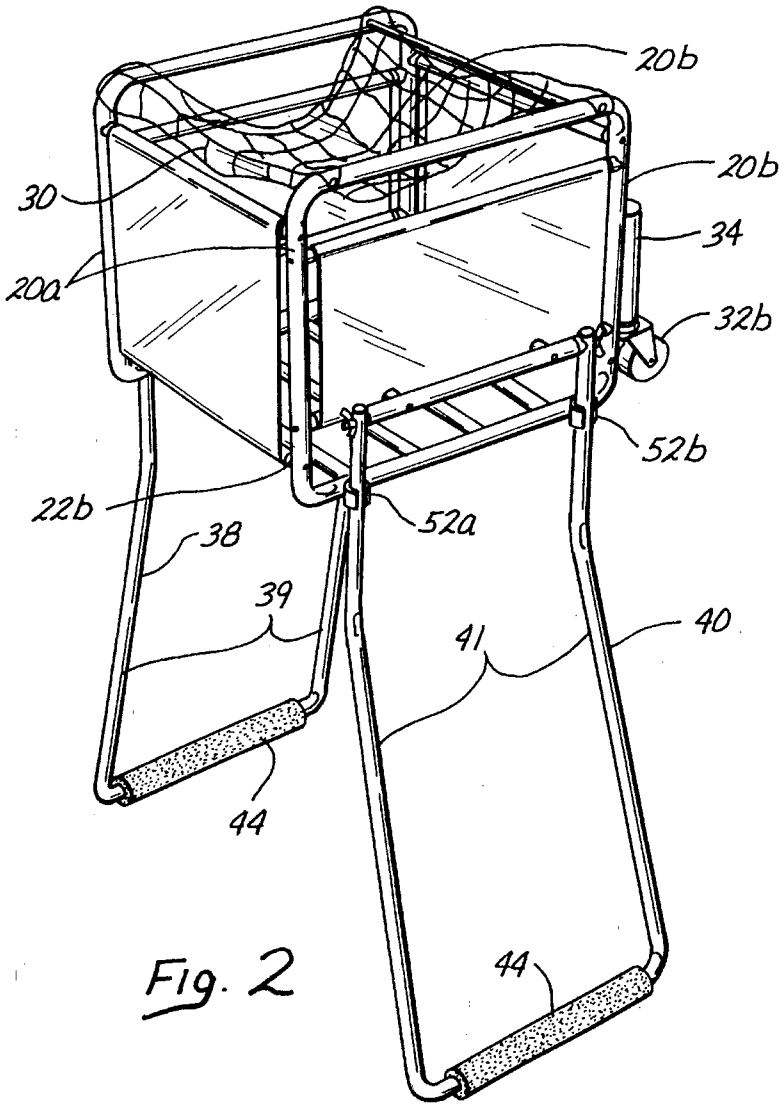
FIG. 2 is a view of the collector/retainer and dispenser disposed in its upstanding position.

Also provided to extend outwardly from each of the lower members 16*a*, 16*b* of the frames 10*a*, 10*b* are a pair of spring clips 52*a*, 52*b*, the function of which is to releasably hold the arms 39, 41 of the U-shaped carrier elements 38, 40 in their second downwardly extending position shown in FIG. 2 of the drawings.

Figure 5:
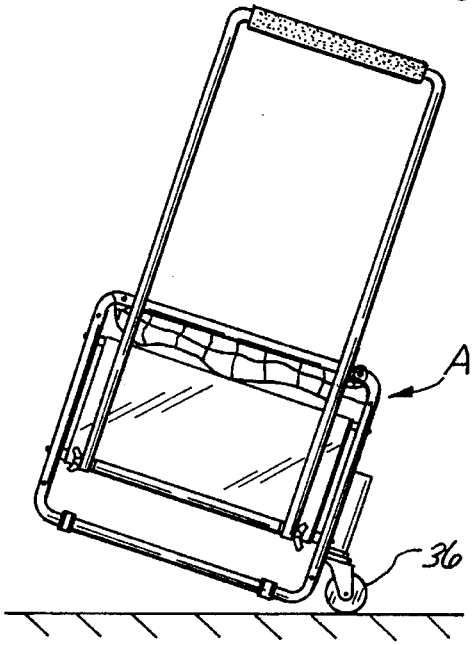
FIG. 5 is a side elevation reduced in size showing the retainer in a position for wheeling across a tennis court.
Figure 6:
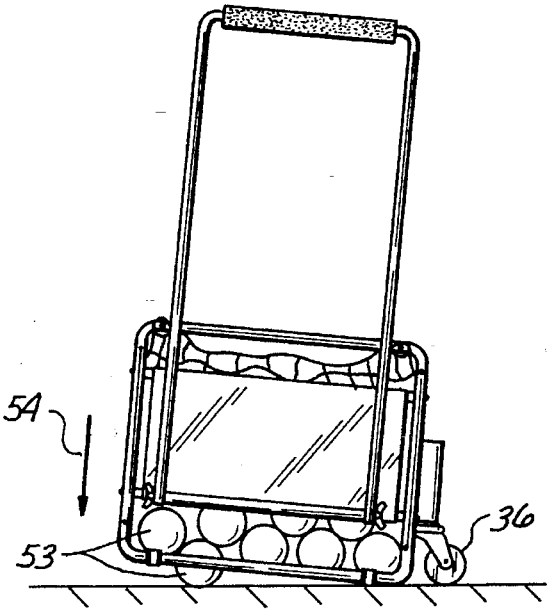
FIG. 6 is a view similar to FIG. 5 showing the collector/retainer/dispenser after it has been brought down over a group of tennis balls and picked up most of them.

In operation, the device shown in FIG. 1 through FIG. 7 is tilted in the manner shown in FIG. 5 to place the weight of the device on the wheels 36, whereby it may be positioned over one or more tennis balls 53, and then tilted back down over the balls 53 in the direction of the arrow 54. Thereby, the bottom of the basket A will compress the balls 53 just enough to force them between tubular members 18 on the underside of the basket A. This process may be repeated until the basket A is substantially filled, whereupon the net 30, if not already disposed on the top of the basket A, may be pulled over the open top and temporarily secured to keep the balls 53 from spilling out of the basket.

When it is desired to reuse the balls 53 which have been picked up and placed in the basket A, the U-shaped members 38 and 40 are then swung down to their second position, as shown in FIG. 2, where they are removably retained by the spring clips 52*a*, 52*b*. The net 30 may then be drawn back at least part way over the top of the basket A and the balls 53 removed one or more at a time for practicing serving or for hitting them over the net to a pupil or other person being taught or otherwise desiring to practice strokes. Should it be desired to move the basket A, it is a simple matter to push the basket A as the loose fitting tubes 46 will serve as rollers.

In the embodiment shown in FIGS. 1–6, the sides of the basket A are shown to be covered with some type of webbing 24, 26 such as a green canvas or plastic sheeting. It would, however, be quite feasible to employ netting 24' 26' as shown in FIG. 7.

Because of the tubular construction, preferably of aluminum, the device is not only light and easy to handle, but will be found to be quite rugged and stable in its second position shown in FIG. 2. Also, because of its tubular construction, it may be shipped unassembled in flat boxes, thereby requiring a minimum of shipping and storage space. In areas of the country where tennis normally cannot be played enjoyably over the winter months, the device may be disassembled and repacked in a box for storage, thereby avoiding deterioration were it left outdoors over the winter or occupying limited space in a garage or other storage facility.

I claim:

1. A ball retrieving and storage receptacle for picking up, retaining and providing an dispenser for compressible balls, said receptacle comprising:

a rectangular retainer, said retainer being formed of a pair of substantially rectangular tubular frames, each frame having first and second tubular side members and top and bottom tubular members joined at their ends to the ends of the side members, said frames being in opposed parallel register and spaced from each other by a first predetermined distance and fixedly secured parallel to each other with such spacing by pairs of first rigid parallel tubes spaced from each other one above the other, and extending between the opposed frames, and secured to said frames adjacent the top and bottom tubular members of the frames, respectively;

a plurality of parallel second rigid parallel tubes extending between the bottom members of the frames, adjacent second tubes being spaced from each other by a distance slightly less than the diameter of the compressible balls, whereby the balls, when slightly compressed, may pass between a pair of adjacent second rigid tubes;

first planar retainer web means extending between each pair of first rigid tubes, said first retainer web means serving to prevent the passage of balls through the spacing separating the upper and lower first rigid tubes;

a third upper tube and a third lower tube spaced from and extending parallel to each other between the side members of each rectangular frame, the third upper tube being adjacent the top member of a tubular frame and the third lower tube being adjacent the lower member of a tubular frame;

second retainer means extending between a pair of third upper and lower tubes, said second retainer means serving to prevent the passage of balls through the spacing between the third upper and lower tubes extending between the side members of a tubular frame;

a rod extending between the side members of each frame, and fixedly secured to a third lower tube;

a pair of carriers, each of said carriers being formed of a pair of substantially parallel rigid rectilinear elongated elements spaced from each other by a distance less than the linear dimension of each of the top and bottom members of the frames, each of said elements having a first end and a second end, and a dimension substantially in excess of the height of the side members of the frame, each of said elements of the carrier pair having a first end pivotally attached to one of said rods, and each of said elements having its second end connected to the second end of the other element by a transverse member to form therewith a handle; whereby, each carrier may pivot between a first position above the rectangular retainer, and a second opposite position below the retainer in which latter position the retainer is supported above any horizontal surface in which the retainer may be placed;

and a pair of wheeled casters secured parallel to each other for swivelling and rolling adjacent the lower ends of opposite side members of the frames, the bottoms of the wheel of each caster being disposed no lower than a plane passing through the bottom members of the frames;

whereby, when the rectangular retainer is tilted onto the wheels of both casters, the retainer may be pulled over a horizontal surface on the said wheels.

2. A ball retrieving and storage receptacle for picking up, retaining and providing an elevated dispenser for compressible balls as described in claim 1 wherein means are provided for releasably securing the carriers in their second position, the last said means being attached to the bottom members of the rectangular frames.

3. A ball retrieving and storage receptacle for picking up, retaining and providing an elevated dispenser for compressible balls as described in claim 2 wherein the means for releasably securing the carriers are spring clips.

4. A ball retrieving and storage receptacle for picking up, retaining and providing an elevated dispenser for compressible balls as described in claim 1 wherein removable cover means are provided to be disposed over the top of the retainer.

5. A ball retrieving and storage receptacle for picking up, retaining and providing an elevated dispenser for compressible balls as described in claim 4 wherein the cover means is a net.

6. A ball retrieving and storage receptacle for picking up, retaining and providing an elevated dispenser for compressible balls as described in claim 1, wherein the first retainer web means is a fabric.

7. A ball retrieving and storage receptacle for picking up, retaining and providing an elevated dispenser for compressible balls as described in claim 1 wherein the second retainer means is a fabric.

8. A ball retrieving and storage receptacle for picking up, retaining and providing an elevated dispenser for compressible balls as described in claim 1 wherein the first retainer web means is a netting.

9. A ball retrieving and storage receptacle for picking up, retaining and providing an elevated dispenser for compressible balls as described in claim 1 wherein the pivotal attachment of the first end of each carrier element is disposed at the end of one of said rods.

10. A ball retrieving and storage receptacle for picking up, retaining and providing an elevated dispenser for compressible balls as described in claim 1 wherein a fourth rigid tube is attached to the outside of each of two opposed side members of a frame, and the wheeled casters are provided for swiveling about the lower ends said fourth rigid tubes.

11. A ball retrieving and storage receptacle for picking up, retaining and providing an elevated dispenser for compressible balls as described in claim 1 wherein a loosely fitted cover tube is provided about the transverse member of each carrier, thereby to serve both as means to grip said transverse member, as well as a roller to provide mobility when the carrier is releasably secured in its second position.

* * * * *